US007875757B2

(12) United States Patent
Nafis et al.

(10) Patent No.: US 7,875,757 B2
(45) Date of Patent: Jan. 25, 2011

(54) COMBINATION REFORMING AND ISOMERIZATION PROCESS

(75) Inventors: Douglas A. Nafis, Mount Prospect, IL (US); Gregory F. Maher, Aurora, IL (US); Lynn H. Rice, Arlington Heights, IL (US); William D. Schlueter, Lake in the Hills, IL (US); Ralph D. Gillespie, Friendswood, TX (US); Michelle J. Cohn, Glenview, IL (US)

(73) Assignee: UOP LLC, Des Plaines, IL (US)

( * ) Notice: Subject to any disclaimer, the term of this patent is extended or adjusted under 35 U.S.C. 154(b) by 428 days.

(21) Appl. No.: 12/129,253

(22) Filed: May 29, 2008

(65) Prior Publication Data

US 2008/0245704 A1 Oct. 9, 2008

Related U.S. Application Data

(60) Division of application No. 11/220,127, filed on Sep. 6, 2005, now Pat. No. 7,435,329, which is a continuation-in-part of application No. 10/872,642, filed on Jun. 21, 2004, now Pat. No. 6,979,396, and a continuation-in-part of application No. 10/872,581, filed on Jun. 21, 2004, now Pat. No. 7,015,175, which is a continuation-in-part of application No. 10/804,358, filed on Mar. 19, 2004, now Pat. No. 7,022,889, which is a continuation-in-part of application No. 10/718,050, filed on Nov. 20, 2003, now Pat. No. 6,927,188, and a continuation-in-part of application No. 10/717,812, filed on Nov. 20, 2003, now Pat. No. 6,881,873, which is a continuation of application No. 09/942,237, and a division of application No. 09/942,237, filed on Aug. 29, 2001, now Pat. No. 6,706,659.

(51) Int. Cl.
*C07C 5/27* (2006.01)

(52) U.S. Cl. ..... 585/750; 585/751

(58) Field of Classification Search ..... 585/750, 585/751; 502/34

See application file for complete search history.

(56) References Cited

U.S. PATENT DOCUMENTS

| | | | | |
|---|---|---|---|---|
| 2,939,896 | A | 6/1960 | Myers | 260/683.68 |
| 2,966,528 | A | 12/1960 | Haensel | 260/666 |
| 2,985,589 | A | 5/1961 | Broughton et al. | 210/34 |
| 3,040,777 | A | 6/1962 | Carson et al. | 137/625.15 |
| 3,175,444 | A | 3/1965 | Spinney | 83/251 |
| 3,422,848 | A | 1/1969 | Liebman et al. | 137/625.15 |
| 3,755,144 | A | 8/1973 | Asselin | 208/95 |
| 3,761,392 | A | 9/1973 | Pollock | 208/93 |
| 3,915,845 | A | 10/1975 | Antos | 208/139 |
| 4,003,826 | A | 1/1977 | Antos | 208/139 |
| 4,024,052 | A | 5/1977 | Antos | 208/139 |
| 4,024,077 | A | 5/1977 | Engelhard et al. | 252/442 |
| 4,061,724 | A | 12/1977 | Grose et al. | 423/335 |
| 4,073,865 | A | 2/1978 | Flanigen et al. | 423/339 |
| 4,087,381 | A | 5/1978 | Antos | 252/441 |
| 4,181,599 | A | 1/1980 | Miller et al. | 208/79 |
| 4,310,440 | A | 1/1982 | Wilson et al. | 252/435 |
| 4,331,822 | A | 5/1982 | Onodera et al. | 585/482 |
| 4,440,871 | A | 4/1984 | Lok et al. | 502/214 |
| 4,457,832 | A | 7/1984 | Robinson | 208/66 |
| 4,485,185 | A | 11/1984 | Onodera et al. | 502/71 |
| 4,567,027 | A | 1/1986 | Detournay et al. | 423/101 |
| 4,567,029 | A | 1/1986 | Wilson et al. | 423/306 |
| 4,709,116 | A | 11/1987 | Zarchy et al. | 585/738 |
| 4,709,117 | A | 11/1987 | Gray, Jr. | 585/738 |
| 4,717,784 | A | 1/1988 | Stem et al. | 585/738 |
| 4,758,419 | A | 7/1988 | Lok et al. | 423/306 |
| 4,804,802 | A | 2/1989 | Evans et al. | 585/734 |
| 4,804,803 | A | 2/1989 | Schmidt et al. | 585/748 |

(Continued)

FOREIGN PATENT DOCUMENTS

EP 0 666 109 A1 8/1995

(Continued)

OTHER PUBLICATIONS

Robert A. Meyers, The Handbook of Petroleum Refining Processes, 1986, 5-49 through 5-51.

(Continued)

*Primary Examiner*—Thuan Dinh Dang
(74) *Attorney, Agent, or Firm*—Maryann Maas

(57) ABSTRACT

A reforming and isomerization process has been developed. A reforming feedstream is charged to a reforming zone containing a reforming catalyst and operating at reforming conditions to generate a reforming zone effluent. Hydrogen and an isomerization feedstream is charged into an isomerization zone to contact an isomerization catalyst at isomerization conditions to increase the branching of the hydrocarbons. The isomerization catalyst is a solid acid catalyst comprising a support comprising a sulfated oxide or hydroxide of at least an element of Group IVB, a first component being at least one lanthanide series element, mixtures thereof, or yttrium, and a second component being a platinum group metal or mixtures thereof. The reforming zone effluent and the isomerization zone effluent are each separated to form a light ends stream and a product stream. The light ends streams are combined for processing in a net gas re-contacting zone.

1 Claim, 4 Drawing Sheets

U.S. PATENT DOCUMENTS

| | | | | |
|---|---|---|---|---|
| 4,834,958 | A | 5/1989 | Zones | 423/277 |
| 4,899,012 | A | 2/1990 | Sachtler et al. | 585/482 |
| 4,909,116 | A | 3/1990 | Tanaka et al. | 84/692 |
| 4,918,041 | A | 4/1990 | Hollstein et al. | 502/217 |
| 4,939,110 | A | 7/1990 | Sachtler et al. | 502/66 |
| 4,956,519 | A | 9/1990 | Hollstein et al. | 585/751 |
| 5,019,671 | A | 5/1991 | Hsu et al. | 585/751 |
| 5,026,951 | A | 6/1991 | Schmidt et al. | 585/738 |
| 5,036,035 | A | 7/1991 | Baba et al. | 502/221 |
| 5,036,085 | A | 7/1991 | Heinemann et al. | 514/361 |
| 5,107,052 | A | 4/1992 | McCulloch et al. | 585/738 |
| 5,120,898 | A | 6/1992 | Baba et al. | 585/750 |
| 5,146,035 | A | 9/1992 | Spehlmann et al. | 585/667 |
| 5,146,037 | A | 9/1992 | Zarchy et al. | 585/738 |
| 5,157,199 | A | 10/1992 | Soled et al. | 585/750 |
| 5,182,247 | A | 1/1993 | Kuhlmann et al. | 502/217 |
| 5,212,136 | A | 5/1993 | Angstadt et al. | 502/206 |
| 5,214,017 | A | 5/1993 | Angstadt et al. | 502/204 |
| 5,310,868 | A | 5/1994 | Angstadt et al. | 585/721 |
| 5,321,197 | A | 6/1994 | Angstadt et al. | 585/721 |
| 5,340,465 | A | 8/1994 | Gillespie et al. | 208/191 |
| 5,360,534 | A | 11/1994 | Rice et al. | 208/139 |
| 5,491,278 | A | 2/1996 | Angstadt et al. | 585/731 |
| 5,493,067 | A | 2/1996 | Angstadt et al. | 585/731 |
| 5,629,257 | A | 5/1997 | Umansky et al. | 502/217 |
| 5,744,684 | A | 4/1998 | Zinnen et al. | 585/737 |
| 5,750,459 | A | 5/1998 | Marella et al. | 502/304 |
| 5,762,887 | A | 6/1998 | Girod et al. | 422/200 |
| 5,762,888 | A | 6/1998 | Sechrist | 422/216 |
| 5,768,904 | A | 6/1998 | Tagamolila et al. | 62/238.3 |
| 5,780,383 | A | 7/1998 | Hollstein et al. | 502/324 |
| 5,786,294 | A | 7/1998 | Sachtler et al. | 502/349 |
| 5,802,870 | A | 9/1998 | Arnold et al. | 62/480 |
| 5,831,139 | A | 11/1998 | Schmidt et al. | 585/315 |
| 5,837,641 | A | 11/1998 | Gosling et al. | 502/219 |
| 5,862,060 | A | 1/1999 | Murray, Jr. | 364/528.01 |
| 6,180,556 | B1 | 1/2001 | Marella et al. | 502/217 |
| 6,184,430 | B1 | 2/2001 | Venkatesh et al. | 585/750 |
| 6,214,764 | B1 | 4/2001 | Gillespie | 502/230 |
| 6,320,089 | B1 | 11/2001 | Gillespie | 585/744 |
| 6,359,179 | B1 | 3/2002 | Nemeth et al. | 568/387 |
| 6,448,198 | B1 | 9/2002 | Szabo et al. | 502/217 |
| 6,495,733 | B1 | 12/2002 | Peratello et al. | 585/743 |
| 6,573,417 | B1 | 6/2003 | Rice | 585/738 |
| 6,593,504 | B1 | 7/2003 | Bricker et al. | 585/470 |
| 6,706,659 | B2 | 3/2004 | Gillespie et al. | 502/217 |
| 6,881,873 | B2 | 4/2005 | Gillespie et al. | 585/477 |
| 6,927,188 | B2 | 8/2005 | Gillespie et al. | 502/217 |
| 6,979,396 | B2 | 12/2005 | Gillespie et al. | 208/62 |
| 7,015,175 | B2 | 3/2006 | Vassilakis et al. | 502/217 |
| 7,022,889 | B2 | 4/2006 | Gillespie et al. | 585/750 |
| 7,326,819 | B2 | 2/2008 | Gillespie et al. | 585/477 |
| 2004/0067845 | A1 | 4/2004 | Furuta et al. | 502/216 |
| 2004/0249230 | A1 | 12/2004 | Gillespie et al. | 585/750 |
| 2005/0023189 | A1 | 2/2005 | Gillespie et al. | 208/79 |
| 2005/0027154 | A1 | 2/2005 | Vassilakis et al. | 585/750 |
| 2005/0161368 | A1 | 7/2005 | Gillespie et al. | 208/112 |

FOREIGN PATENT DOCUMENTS

| | | | |
|---|---|---|---|
| EP | 0983967 | A1 | 3/2000 |
| EP | 1002579 | A1 | 5/2000 |
| JP | 61242641 | A | 4/1985 |

OTHER PUBLICATIONS

*Graham* v. *John Deere Co*., U.S. 1,148 USPQ 459 (1966).

*Ex parte Rubin* (POBA 1959) 128 U.S.P.Q. 440.

*Cohn* v. *Comr. Pats*. (DCDC 1966) 251 F Supp 378, 148 U.S.P.Q. 486.

*In re Boe*, 145 U.S.P.Q. 507 (CCPA 1966).

Patent Abstracts of Japan, vol. 011, No. 089 Mar. 19, 1987 & JP 61 242641 A (Res Assoc Util of Light Oil), Oct. 28, 1986 abstract.

Database WPI Section CH, Week 198649 Derwent Publications Ltd., London, GB, AN 1986-323907 XP002222499 & JP 61 242641 A (Keishitsu Ryubun Shinyoto), Oct. 28, 1986 abstract.

COMBINATION REFORMING AND ISOMERIZATION PROCESS

CROSS-REFERENCE TO RELATED APPLICATIONS

This application is a Division of application Ser. No. 11/220,127 filed Sep. 6, 2005, now U.S. Pat. No. 7,435,329, which in turn is a Continuation-In-Part of applications Ser. No. 10/872,642 and Ser. No. 10/872,581 both filed Jun. 21, 2004, now U.S. Pat. Nos. 6,979,396 and 7,015,175, respectively, which applications are a Continuation-In-Part of application Ser. No. 10/804,358 filed Mar. 19, 2004, now U.S. Pat. No. 7,022,889, which application is a Continuation-In-Part of applications Ser. No. 10/718,050 and Ser. No. 10/717,812 both filed Nov. 20, 2003, now U.S. Pat. No. 6,927,188 and U.S. Pat. No. 6,881,873, respectively, which applications are a Continuation and a Division, respectively, of application Ser. No. 09/942,237 filed Aug. 29, 2001, now U.S. Pat. No. 6,706,659 the contents of all are hereby incorporated by reference in their entirety.

STATEMENT REGARDING FEDERALLY SPONSORED RESEARCH OR DEVELOPMENT

This work was performed under the support of the U.S. Department of Commerce, National Institute of Standards and Technology, Advanced Technology Program, Cooperative Agreement Number 70NANB9H3035. The United States Government has certain rights in this invention.

FIELD OF THE INVENTION

This invention relates generally to the parallel reforming and isomerization of hydrocarbons with integrated processing of the light ends of the reforming zone and the isomerization zone. This invention relates more specifically to the reforming of from $C_6$ to $C_{12}$ hydrocarbons and the isomerization of light paraffins using a novel solid catalyst in the isomerization zone.

BACKGROUND OF THE INVENTION

High octane gasoline is required for modern gasoline engines. Formerly it was common to accomplish octane number improvement by the use of various lead-containing additives. As lead is phased out of gasoline for environmental reasons, it has become increasingly necessary to rearrange the structure of the hydrocarbons used in gasoline blending in order achieve higher octane ratings. Catalytic reforming and catalytic isomerization are two widely used processes for this upgrading.

The traditional gasoline blending pool normally includes $C_4$ and heavier hydrocarbons having boiling points of less than 205° C. (395° F.) at atmospheric pressure. This range of hydrocarbon includes $C_4$-$C_6$ paraffins and especially the $C_5$ and $C_6$ normal paraffins which have relatively low octane numbers. The $C_4$-$C_6$ hydrocarbons have the greatest susceptibility to octane improvement by lead addition and were formerly upgraded in this manner. With eventual phase out of lead additives octane improvement was obtained by using isomerization to rearrange the structure of the paraffinic hydrocarbons into branched-chain paraffins or reforming to convert the $C_6$ and heavier hydrocarbons to aromatic compounds. Normal $C_5$ hydrocarbons are not readily converted into aromatics, therefore, the common practice has been to isomerize these lighter hydrocarbons into corresponding branched-chain isoparaffins. Although the $C_6$ and heavier hydrocarbons can be upgraded into aromatics through hydrocyclization, the conversion of $C_6$'s to aromatics creates higher density species and increases gas yields with both effects leading to a reduction in liquid volume yields. Moreover, the health concerns related to benzene are likely to generate overall restrictions on benzene and possibly aromatics as well, which some view as precursors for benzene tail pipe emissions. Therefore, it is preferred to charge the $C_6$ paraffins to an isomerization unit to obtain $C_6$ isoparaffin hydrocarbons. Consequently, octane upgrading commonly uses isomerization to convert $C_6$ and lighter boiling hydrocarbons.

Combination processes using isomerization and reforming to convert naphtha range feedstocks are well known. U.S. Pat. No. 4,457,832 uses reforming and isomerization in combination to upgrade a naphtha feedstock by first reforming the feedstock, separating a $C_5$-$C_6$ paraffin fraction from the reformate product, isomerizing the $C_5$-$C_6$ fraction to upgrade the octane number of these components and recovering a $C_5$-$C_6$ isomerate liquid which may be blended with the reformate product. U.S. Pat. No. 4,181,599 and U.S. Pat. No. 3,761,392 show a combination isomerization-reforming process where a full range naphtha boiling feedstock enters a first distillation zone which splits the feedstock into a lighter fraction which enters an isomerization zone and a heavier fraction that is charged as feed to a reforming zone. In both the '392 and '599 patents, reformate from one or more reforming zones undergoes additional separation and conversion, the separation including possible aromatics recovery, which results in additional $C_5$-$C_6$ hydrocarbons being charged to the isomerization zone.

The effluent from a reforming zone will contain a portion of hydrogen which may be used in the isomerization zone. Therefore combining the effluents to separate a stream containing hydrogen for recycle to the isomerization zone may be desirable, but a refiner may lose blending flexibility and may prefer to keep the isomerate and reformate separate from one another. Even while keeping the isomerate and reformate separate, cost savings may be achieved through integration of the net gas recovery zone between the reforming process and the isomerization process. The light ends from the isomerization zone effluent may be combined with the light ends of the reforming zone effluent and the combined light ends stream may be processed in a single net gas re-contacting zone. Portions of the resulting gas stream may be recycled.

The present invention involves a reforming zone and an isomerization zone where a portion of the isomerization zone light ends is directed to a net gas re-contacting zone in the reforming zone and where the isomerization zone uses a novel catalyst. Also, the reforming zone stabilizer overhead and the isomerization zone stabilizer overhead may use an integrated overhead receiver. The isomerization catalyst is a solid acid catalyst comprising a support comprising a sulfated oxide or hydroxide of at least an element of Group UVB (IUPAC 4) of the Periodic Table, a first component selected from the group consisting of at least one lanthanide-series element, mixtures thereof, and yttrium, and a second component selected from the group of platinum-group metals and mixtures thereof. In one embodiment of the invention, the atomic ratio of the first component to the second component is at least about 2. In another embodiment of the invention, the isomerization catalyst further comprises from about 2 to 50 mass-% of a refractory inorganic-oxide binder. In yet another embodiment of the invention, the isomerization catalyst further comprises from about 2 to 50 mass-% of a refractory inorganic-oxide binder having one or more platinum group metals dispersed thereon.

SUMMARY OF THE INVENTION

The invention is a process having both a reforming zone and an isomerization zone involving charging a reforming feedstream to a reforming zone containing a reforming catalyst and operating at reforming conditions to generate a reforming zone effluent and charging hydrogen and an isomerization feedstream comprising $C_5$-$C_6$ hydrocarbons into an isomerization zone and contacting said hydrogen and feedstream with an isomerization catalyst at isomerization conditions to increase the branching of the feedstream hydrocarbons and produce an isomerization effluent stream comprising at least normal pentane, normal hexane, methylbutane, dimethylbutane, and methylpentane. The isomerization catalyst is a solid acid catalyst comprising a support comprising a sulfated oxide or hydroxide of at least an element of Group IVB (IUPAC 4) of the Periodic Table, a first component selected from the group consisting of at least one lanthanide-series element, mixtures thereof, and yttrium, and a second component selected from the group of platinum-group metals and mixtures thereof. The reforming zone effluent is separated into a light ends stream and a reformate stream and the isomerization zone effluent is separated into a light ends stream and an isomerate stream. The reforming zone light ends stream and the isomerization zone light ends stream are combined and further processed in a net gas recontacting zone.

The atomic ratio of the first component of the isomerization catalyst to the second component of the isomerization catalyst may be at least about 2, and the catalyst may further comprise from about 2 to 50 mass-% of a refractory inorganic-oxide binder. The first component of the isomerization catalyst may be selected from the group consisting of lutetium, ytterbium, thulium, erbium, holmium, terbium, combinations thereof, and yttrium. The isomerization catalyst may further comprise a third component selected from the group consisting of iron, cobalt, nickel, rhenium, and mixtures thereof.

Additional objects, embodiments and details of this invention can be obtained from the following detailed description of the invention.

DETAILED DESCRIPTION OF THE INVENTION

Figure 1:
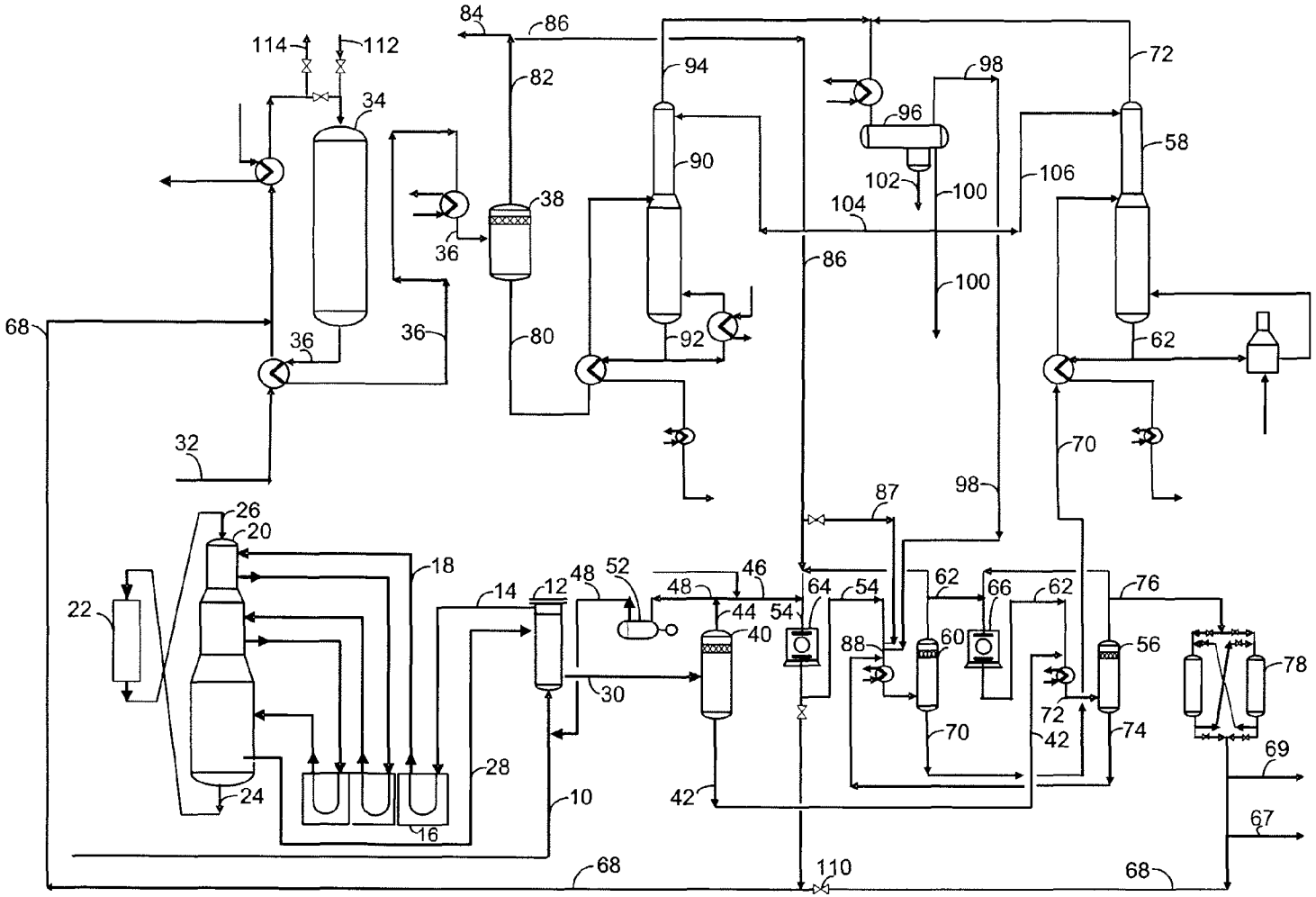
FIG. 1 is a schematic drawing of the process of this invention where the reforming zone is operated in the continuous regeneration mode.

In general terms, one embodiment of the invention comprises both a reforming zone and an isomerization zone operating concurrently, wherein a portion of the light ends from each zone are combined for further processing using a common net gas re-contacting zone thereby reducing equipment and operating costs. Other beneficial process integrations, such as a common stabilizer overhead receiver, will also be described below.

With respect to the reforming zone, a wide variety of reforming zone feed stocks may be used. In general, the reforming zone feed stock contains from $C_6$ to about $C_{11}$ or $C_{12}$ hydrocarbons with a boiling point range from about 82 to about 240° C. Specific reforming zone feedstocks may be generated using separation techniques. For example, a naphtha feedstock may be introduced into a separation zone comprising one or more fractional distillation columns to separate a heart-cut naphtha fraction from a heavy naphtha fraction. The lower-boiling heart-cut naphtha may contain a substantial concentration of $C_7$ and $C_8$ hydrocarbons, which can be catalytically reformed to produce a reformate component suitable for blending into current reformulated gasolines. This heart-cut naphtha also may contain significant concentrations of $C_6$ and $C_9$ hydrocarbons, plus smaller amounts of lower- and higher-boiling hydrocarbons, depending on the applicable gasoline specifications and product needs. The heart-cut naphtha end point may range from about 130° to 175° C., and preferably is within the range of about 145° to 165° C. The higher-boiling heavy naphtha may contain a substantial amount of $C_{10}$ hydrocarbons, and also may contain significant quantities of lighter and heavier hydrocarbons depending primarily on a petroleum refiner's overall product balance. The initial boiling point of the heavy naphtha is between about 120° and 175° C., and preferably is between 140° and 165° C.

A light naphtha fraction may also be separated from the naphtha feedstock in a separation zone. The light naphtha comprises pentanes, and may comprise $C_6$ and possibly a limited amount of $C_7$ hydrocarbons. This fraction may be separated from the heart-cut naphtha because pentanes are not converted efficiently in a reforming zone, and optionally because $C_6$ hydrocarbons may be an undesirable feed to catalytic reforming where they are converted to benzene for which gasoline restrictions are being implemented. The light naphtha fraction may be separated from the naphtha feedstock before it enters the separation zone, in which case the separation zone would only separate heart-cut naphtha from heavy naphtha. If the pentane content of the naphtha feedstock is substantial, however, separation of light naphtha generally is desirable. This alternative separation zone generally comprises two fractionation columns, although in some cases a single column recovering light naphtha overhead, heavy naphtha from the bottom and heart-cut naphtha as a side stream could be suitable.

For purposes of describing this invention, the reforming zone feedstock will contain from $C_6$ to about $C_{12}$ hydrocarbons with a boiling point range from about 82 to about 204° C. The reforming zone feedstock is introduced to a heat exchanger to exchange heat with the reforming zone effluent stream. The heated reforming zone feed stream is then conducted to the reforming zone. The reforming zone upgrades the octane number of the reforming feed stream through a variety of reactions including naphthene dehydrogenation and paraffin dehydrocyclization and isomerization. The product reformate, which may contain a small amount of isomerate, may be used for gasoline blending to form motor fuel or may be further processed.

Reforming operating conditions used in the reforming zone of the present invention include a pressure of from about atmospheric to about 6080 kPaa, with the preferred range being from atmospheric to about 2026 kPaa and a pressure of below 1013 kPaa being especially preferred. Hydrogen is generated within the reforming zone, but additional hydrogen may be directed, if necessary, to the reforming zone in an amount sufficient to correspond to a ratio of from about 0.1 to 10 moles of hydrogen, but generated and added, per mole of hydrocarbon feedstock. The volume of the contained reforming catalyst corresponds to a liquid hourly space velocity of from about 1 to 40 $hr^{-1}$. The operating temperature generally is in the range of 260° to 560° C.

The reforming catalyst comprises a supported platinum-group metal component. This component comprises one or more platinum-group metals, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The preferred platinum component generally comprises from about 0.01 to 2 mass % of the catalytic composite, preferably 0.05 to 1 mass %, calculated on an elemental basis.

It is within the scope of the present invention that the catalyst may contain other metal components known to modify the effect of the preferred platinum component. Such metal modifiers may include Group IVA (14) metals, other Group VIII (8-10) metals, rhenium, indium, gallium, zinc, uranium, dysprosium, thallium and mixtures thereof. A preferred metal modifier is a tin component. Catalytically effective amounts of such metal modifiers may be incorporated into the catalyst by any means known in the art.

The reforming catalyst conveniently is a dual-function composite containing a metallic hydrogenation-dehydrogenation component on a refractory support which provides acid sites for cracking and isomerization. The refractory support of the reforming catalyst should be a porous, adsorptive, high-surface-area material which is uniform in composition without composition gradients of the species inherent to its composition. Within the scope of the present invention are refractory supports containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (WJPAC Commission on Zeolite Nomenclature), in hydrogen form or in a form which has been exchanged with metal cations; (4) non-zeolitic molecular sieves as disclosed in U.S. Pat. No. 4,741,820, incorporated by reference; (5) spinets such as $MgAl_2O_4$, $FeAl_2O_4$, $ZnAl_2O_4$, $CaAl_2O_4$; and (6) combinations of materials from one or more of these groups.

The preferred refractory support for the reforming catalyst is alumina, with gamma- or eta-alumina being particularly preferred. Best results are obtained with an alumina is that which has been characterized in U.S. Pat. No. 3,852,190 and U.S. Pat. No. 4,012,313 as a byproduct from a Ziegler higher alcohol synthesis reaction as described in Ziegler's U.S. Pat. No. 2,892,858. For purposes of simplification, such an alumina will be hereinafter referred to as a "Ziegler alumina." Ziegler alumina is presently available from the Vista Chemical Company under the trademark "Catapal" or from Condea Chemie GMBH under the trademark "Pural." This material is an extremely high purity pseudo-boehmite powder which, after calcination at a high temperature, has been shown to yield a high-purity gamma-alumina.

The alumina powder may be formed into any shape or form of carrier material known to those skilled in the art such as spheres, extrudates, rods, pills, pellets, tablets or granules. Preferred spherical particles may be formed by converting the alumina powder into alumina sol by reaction with suitable peptizing acid and water and dropping a mixture of the resulting sol and gelling agent into an oil bath to form spherical particles of an alumina gel, followed by known aging, drying and calcination steps. The alternative extrudate form is preferably prepared by mixing the alumina powder with water and suitable peptizing agents, such as nitric acid, acetic acid, aluminum nitrate and like materials, to form an extrudable dough having a loss on ignition (LOI) at 500° C. of about 45 to 65 mass %. The resulting dough is extruded through a suitably shaped and sized die to form extrudate particles, which are dried and calcined by known methods. Alternatively, spherical particles can be formed from the extrudates by rolling the extrudate particles on a spinning disk.

The reforming catalyst optimally contains a halogen component. The halogen component may be either fluorine, chlorine, bromine or iodine or mixtures thereof. Chlorine is the preferred halogen component. The halogen component is generally present in a combined state with the inorganic-oxide support. The halogen component is preferably well dispersed throughout the catalyst and may comprise from more than 0.2 to about 15 mass %, calculated on an elemental basis, of the final catalyst. Further details of the preparation and activation of embodiments of the above reforming catalyst are disclosed in U.S. Pat. No. 4,677,094, which is hereby incorporated by reference in its entirety.

In an advantageous alternative embodiment, the reforming catalyst comprises a large-pore molecular sieve. The term "large-pore molecular sieve" is defined as a molecular sieve having an effective pore diameter of about 7 angstroms or larger. Examples of large-pore molecular sieves which might be incorporated into the present catalyst include LTL, FAU, AFI and MAZ (IUPAC Commission on Zeolite Nomenclature) and zeolite-beta.

Preferably the alternative embodiment of the reforming catalyst contains a nonacidic L-zeolite (LTL) and an alkali-metal component as well as a platinum-group metal component. It is essential that the L-zeolite be nonacidic, as acidity in the zeolite lowers the selectivity to aromatics of the finished catalyst. In order to be "nonacidic," the zeolite has substantially all of its cationic exchange sites occupied by nonhydrogen species. Preferably the cations occupying the exchangeable cation sites will comprise one or more of the alkali metals, although other cationic species may be present. An especially preferred nonacidic L-zeolite is potassium-form L-zeolite.

It is necessary to composite the L-zeolite with a binder in order to provide a convenient form for use in the catalyst of the present invention. The art teaches that any refractory inorganic oxide binder is suitable. One or more of silica, alumina or magnesia are preferred binder materials of the present invention. Amorphous silica is especially preferred, and excellent results are obtained when using a synthetic white silica powder precipitated as ultra-fine spherical particles from a water solution. The silica binder preferably is nonacidic, contains less than 0.3 mass % sulfate salts, and has a BET surface area of from about 120 to 160 $m^2/g$.

The L-zeolite and binder may be composited to form the desired catalyst shape by any method known in the art. For example, potassium-form L-zeolite and amorphous silica may be comingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcination. The resulting dough is extruded through a suitably shaped and sized die to form extrudate particles, which are dried and calcined by known methods. Alternatively, spherical particles may be formed by methods described hereinabove for the first reforming catalyst.

An alkali metal component is an essential constituent of the alternative reforming catalyst. One or more of the alkali metals, including lithium, sodium, potassium, rubidium, cesium and mixtures thereof, may be used, with potassium being preferred. The alkali metal optimally will occupy essentially all of the cationic exchangeable sites of the nonacidic L-zeolite. Surface-deposited alkali metal also may be present as described in U.S. Pat. No. 4,619,906, incorporated herein by reference.

Further details of the preparation and activation of embodiments of the alternative reforming catalyst are disclosed, e.g., in U.S. Pat. No. 4,619,906 and U.S. Pat. No. 4,822,762, which are incorporated into this specification by reference.

The final reforming catalyst generally will be dried at a temperature of from about 100° to 320° C. for about 0.5 to 24 hours, followed by oxidation at a temperature of about 300° to 550° C. in an air atmosphere for 0.5 to 10 hours. Preferably the oxidized catalyst is subjected to a substantially water-free reduction step at a temperature of about 300° to 550° C. (preferably about 350° C.) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained.

The reforming zone feed stream may contact the reforming catalyst in either upflow, downflow, or radial-flow mode. The catalyst is contained in a fixed-bed reactor or in a moving-bed reactor whereby catalyst may be continuously withdrawn and added. These alternatives are associated with catalyst-regeneration options known to those of ordinary skill in the art, such as: (1) a semi-continuous regenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or: (4) a hybrid system with semi-continuous regenerative and continuous-regeneration provisions in the same unit. The preferred embodiment of the present invention is a moving-bed reactor with continuous catalyst regeneration, in order to realize high yields of desired $C_5$+product at relatively low operating pressures associated with more rapid catalyst deactivation. The total product stream from the reforming zone generally is conducted to the heat exchanger to exchange heat with the reforming zone feedstock.

Concurrently with the conversion occurring the in the reforming zone, isomerization is occurring in the isomerization zone. The feedstock to the isomerization zone includes a hydrocarbon fraction rich in $C_4$-$C_7$ normal paraffins. The term "rich" is defined to mean a stream having more than 50% of the mentioned component. Preferred feedstocks are substantially pure normal paraffin streams having from 5 to 6, and some having 7 carbon atoms or a mixture of such substantially pure normal paraffins. Other useful feedstocks include light natural gasoline, light straight run naphtha, gas oil condensate, light raffinates, light reformate, light hydrocarbons, field butanes, and straight run distillates having distillation end points of about 77° C. and containing substantial quantities of $C_4$-$C_6$ paraffins. The feed stream may also contain low concentrations of unsaturated hydrocarbons and hydrocarbons having more than 6 carbon atoms.

Hydrogen is admixed with the feed in an amount that will provide a hydrogen to hydrocarbon ratio equal to from about 0.05 to about 5.0 in the effluent from the isomerization zone. Hydrogen may be consumed in the isomerization zone, especially in the saturation of benzene. Additionally, the isomerization zone will have a net consumption of hydrogen often referred to as the stoichiometric hydrogen requirement which is associated with a number of side reactions that occur. These side reactions include cracking and disproportionation. Other reactions that will also consume hydrogen include olefin and aromatics saturation. For feeds having a low level of unsaturates, satisfying the stoichiometric hydrogen requirements demands a hydrogen to hydrocarbon molar ratio for the inlet stream of between 0.05 and 5.0. Hydrogen in excess of the stoichiometric amounts for the side reactions is maintained in the reaction zone to provide good stability and conversion by compensating for variations in feed stream compositions that alter the stoichiometric hydrogen requirements.

Hydrogen may be added to the feed mixture in any manner that provides the necessary control for the addition of small hydrogen quantities. Metering and monitoring devices for this purpose are well known by those skilled in the art. A control valve may be used to meter the addition of hydrogen to the feed mixture. The hydrogen concentration in the outlet stream or one of the outlet stream fractions is monitored by a hydrogen monitor and the control valve setting position is adjusted to maintain the desired hydrogen concentration. The hydrogen concentration at the effluent is calculated on the basis of total effluent flow rates.

The hydrogen may be provided as part of a stream generated through the separation of a combined light ends stream having a portion of the light ends from the reforming zone and a portion of the light ends from the isomerization zone. The generated stream will contain hydrogen from the reforming process which may supplement or replace an independent hydrogen source for the isomerization zone.

The hydrogen and hydrocarbon feed mixture is contacted in the isomerization zone with a novel isomerization catalyst. The novel isomerization catalyst comprises a sulfated support of an oxide or hydroxide of a Group UVB (IUPAC 4) metal, preferably zirconium oxide or hydroxide, at least a first component which is a lanthanide element or yttrium component, and at least a second component being a platinum-group metal component. Preferably, the first component contains at least ytterbium and the second component is platinum. The catalyst optionally contains an inorganic-oxide binder, especially alumina. The catalyst is fully described in U.S. Pat. No. 6,706,659 which is hereby incorporated by reference in its entirety.

The support material of the isomerization catalyst of the present invention comprises an oxide or hydroxide of a Group IVB (IUPAC 4). In one embodiment the Group IVB element is zirconium or titanium. Sulfate is composited on the support material. A component of a lanthanide-series element is incorporated into the composite by any suitable means. A platinum-group metal component is added to the isomerization catalytic composite by any means known in the art to effect the catalyst of the invention, e.g., by impregnation. Optionally, the catalyst is bound with a refractory inorganic oxide. The support, sulfate, metal components and optional binder may be composited in any order effective to prepare a catalyst useful for the isomerization of hydrocarbons.

Production of the support of the isomerization catalyst is described in U.S. Pat. No. 6,706,659 and not reproduced here. A sulfated support is prepared by treatment with a suitable sulfating agent to form a solid strong acid. Sulfate ion is incorporated into a catalytic composite, for example, by treatment with sulfuric acid in a concentration usually of about 0.01-10N and preferably from about 0.1-5N. Compounds such as hydrogen sulfide, mercaptans or sulfur dioxide, which are capable of forming sulfate ions upon calcining, may be employed as alternative sources. Ammonium sulfate may be employed to provide sulfate ions and form a solid strong acid catalyst. The sulfur content of the finished catalyst generally is in the range of about 0.5 to 5 mass-%, and preferably is from about 1 to 2.5 mass-%. The sulfated composite is dried, preferably followed by calcination at a temperature of about 500 to 800° C. particularly if the sulfation is to be followed by incorporation of the platinum-group metal.

A first component, comprising one or more of the lanthanide-series elements, yttrium, or mixtures thereof, is another essential component of the present catalyst. Included in the lanthanide series are lanthanum, cerium, praseodymium, neodymium, promethium, samarium, europium, gadolinium, terbium, dysprosium, holmium, erbium, thulium, ytterbium and lutetium. Preferred lanthanide series elements include lutetium, ytterbium, thulium, erbium, holmium, terbium, and mixtures thereof. Ytterbium is a most preferred component of the present catalyst. The first component may in general be present in the catalytic composite in any catalytically available form such as the elemental metal, a compound such as the oxide, hydroxide, halide, oxyhalide, carbonate or nitrate or in chemical combination with one or more of the other ingredients of the catalyst. The first component is preferably an oxide, an intermetallic with platinum, a sulfate, or in the zirconium lattice. The materials are generally calcined between 600 and 800° C. and thus in the oxide form. The lanthanide element or yttrium component can be incorporated into the catalyst in any amount which is catalytically effective, suitably from about 0.01 to about 10 mass-% lanthanide or yttrium, or mixtures, in the catalyst on an elemental basis. Best results usually are achieved with about 0.5 to about 5 mass-% lanthanide or yttrium, calculated on an elemental basis. The preferred atomic ratio of lanthanide or yttrium to platinum-group metal for this catalyst is at least about 1:1, preferably about 2:1 or greater, and especially about 5:1 or greater.

The first component is incorporated in the isomerization catalytic composite in any suitable manner known to the art, such as by coprecipitation, coextrusion with the porous carrier material, or impregnation of the porous carrier material either before, after, or simultaneously with sulfate though not necessarily with equivalent results.

A second component, a platinum-group metal, is an essential ingredient of the catalyst. The second component comprises at least one of platinum, palladium, ruthenium, rhodium, iridium, or osmium; platinum is preferred, and it is especially preferred that the platinum-group metal consists essentially of platinum. The platinum-group metal component may exist within the final catalytic composite as a compound such as an oxide, sulfide, halide, oxyhalide, etc., in chemical combination with one or more of the other ingredients of the composite or as the metal. Amounts in the range of from about 0.01 to about 2-wt. % platinum-group metal component, on an elemental basis, are preferred. Best results are obtained when substantially all of the platinum-group metal is present in the elemental state.

The second component, a platinum-group metal component, is deposited on the composite using the same means as for the first component described above. Illustrative of the decomposable compounds of the platinum group metals are chloroplatinic acid, ammonium chloroplatinate, bromoplatinic acid, dinitrodiamino platinum, sodium tetranitroplatinate, rhodium trichloride, hexa-amminerhodium chloride, rhodium carbonylchloride, sodium hexanitrorhodate, chloropalladic acid, palladium chloride, palladium nitrate, diamminepalladium hydroxide, tetraamminepalladium chloride, hexachloroiridate (IV) acid, hexachloroiridate (III) acid, ammonium hexachloroiridate (I), ammonium aquohexachloroiridate (IV), ruthenium tetrachloride, hexachlororuthenate, hexa-amminerutheniumchloride, osmium trichloride and ammonium osmium chloride. The second component, a platinum-group component, is deposited on the support either before, after, or simultaneously with sulfate and/or the first component though not necessarily with equivalent results. It is preferred that the platinum-group component is deposited on the support either after or simultaneously with sulfate and/or the first component. Similarly, the second component, a platinum-group component, is deposited on the support either before, after, or simultaneously with the compositing with binder though not necessarily with equivalent results. When the platinum-group component is deposited on the support either after or simultaneously with the compositing with the binder, the platinum-group component will be deposited on the binder as well as on the support.

In addition to the first and second components above, the isomerization catalyst may optionally further include a third component of iron, cobalt, nickel, rhenium or mixtures thereof. Iron is preferred, and the iron may be present in amounts ranging from about 0.1 to about 5-wt. % on an elemental basis. The third component, such as iron, may function to lower the amount of the first component, such as ytterbium, needed in the optimal formulation. The third component may be deposited on the composite using the same means as for the first and second components as described above. When the third component is iron, suitable compounds would include iron nitrate, iron halides, iron sulfate and any other soluble iron compound.

The isomerization catalytic composite described above can be used as a powder or can be formed into any desired shapes such as pills, cakes, extrudates, powders, granules, spheres, etc., and they may be utilized in any particular size. The composite is formed into the particular shape by means well known in the art. In making the various shapes, it may be desirable to mix the composite with a binder. However, it must be emphasized that the catalyst may be made and successfully used without a binder. The binder, when employed, usually comprises from about 0.1 to 50 mass-%, preferably from about 5 to 20 mass-%, of the finished catalyst. The art teaches that any refractory inorganic oxide binder is suitable. One or more of silica, alumina, silica-alumina, magnesia and mixtures thereof are suitable binder materials of the present invention. A preferred binder material is alumina, with eta- and/or especially gamma-alumina being favored. Examples of binders which can be used include but are not limited to alumina, silica, silica-alumina and mixtures thereof. Usually the composite and optional binder are mixed along with a peptizing agent such as HCl, $HNO_3$, KOH, etc. to form a homogeneous mixture which is formed into a desired shape by forming means well known in the art. These forming means include extrusion, spray drying, oil dropping, marumarizing, conical screw mixing, etc. Extrusion means include screw extruders and extrusion presses. The forming means will determine how much water, if any, is added to the mixture. Thus, if extrusion is used, then the mixture should be in the form of a dough, whereas if spray drying or oil dropping is used, then enough water needs to be present in order to form a slurry. These particles are calcined at a temperature of about 260° C. to about 650° C. for a period of about 0.5 to about 2 hours. The deposition of the first and/or second components may be performed after the binder has been added to the support, or simultaneously with the addition of the binder.

The isomerization catalytic composites of the present invention either as synthesized or after calcination can be used as isomerization catalysts in the present invention. Calcination is required to form zirconium oxide from zirconium hydroxide.

Figure 2:
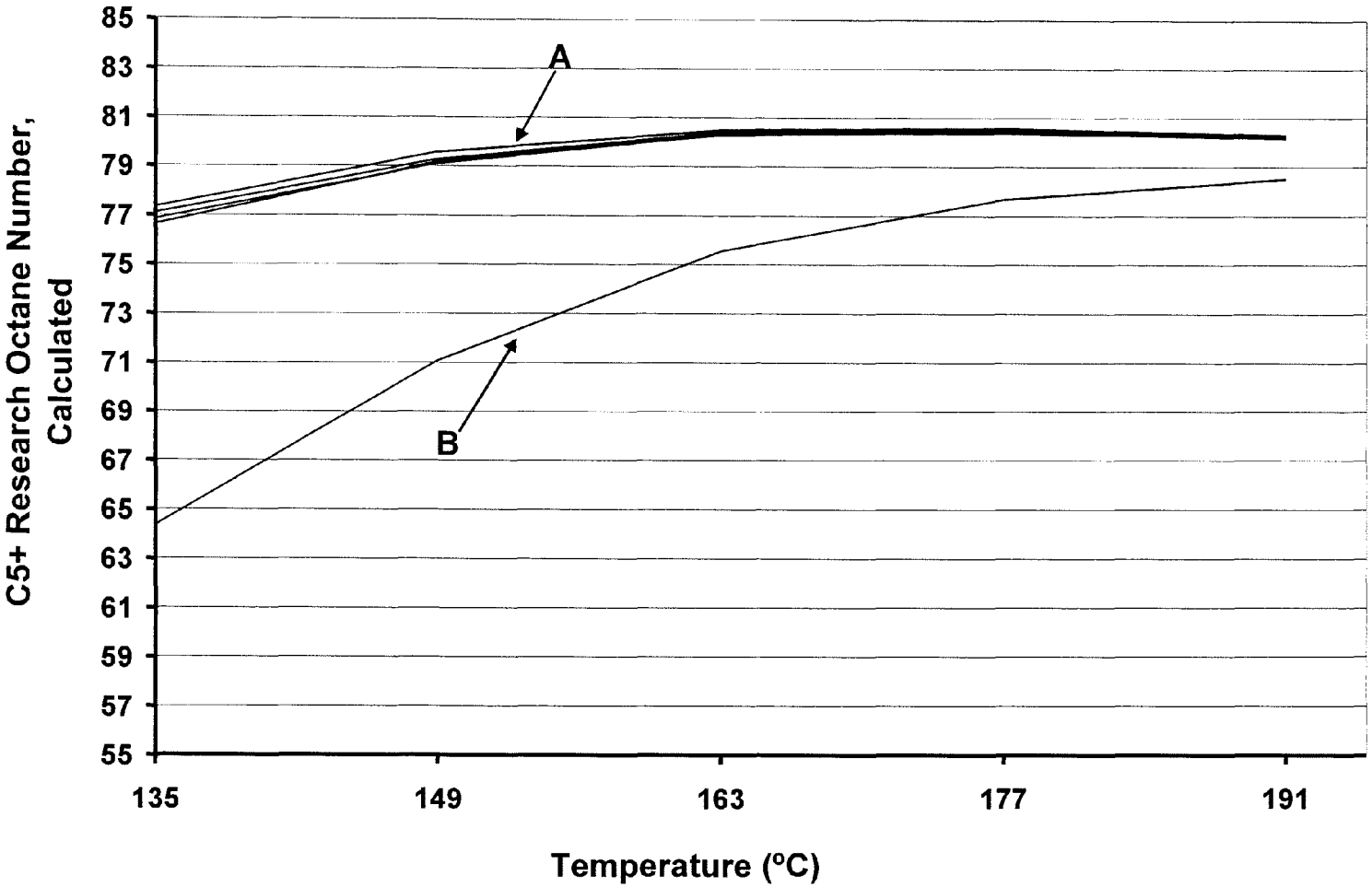
FIG. 2 is a plot of the octane number of the isomerized product streams versus temperature for an isomerization process using an available sulfated zirconia catalyst as compared to the isomerization catalyst the present invention.
Figure 3:
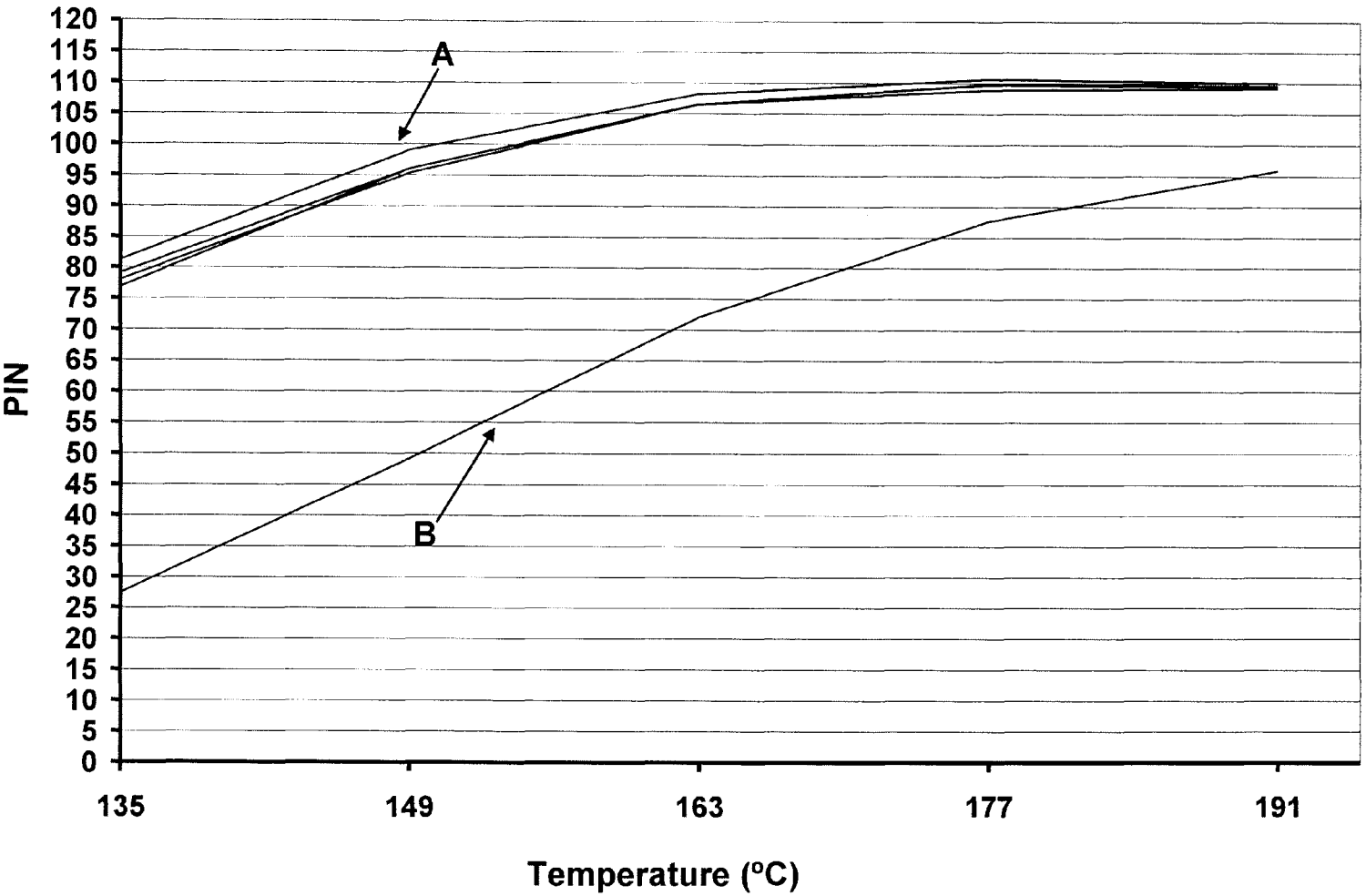
FIG. 3 is a plot of the PIN number in a product stream versus temperature for an isomerization process using an available sulfated zirconia catalyst as compared to the isomerization catalyst of the present invention.

One unexpected benefit of the present invention is the dramatic increase in the high octane components of the isomerized product. The example and FIG. 2 show a comparison of the research octane number of the product stream generated using the novel isomerization catalyst of the present invention (repeated experiments) with that generated using an available sulfated zirconia catalyst as described in U.S. Pat. No. 5,036,085 and U.S. Pat. No. 5,120,898 hereby incorporated by reference in their entirety. The increase in highly valued products is partially explained by the increased ability of the catalyst of the present invention to convert normal paraffins into isoparaffins. The example and FIG. 3 show that the normal paraffin compounds that are converted to isoparaffin compounds using the present invention are substantially greater than those generated using an available sulfated zirconia catalyst. FIG. 3 shows the paraffin isomerization number (PIN) of the product stream as plotted versus temperature. The PIN number is a measure of the amount of iso-$C_5$ paraffin and the highest octane $C_6$ paraffins in a stream. The PIN is calculated as follows:

$$PIN=(\text{wt \% i-}C_5/\text{wt \% }C_5\text{ paraffins})+(\text{wt \% 22DMB}+\text{wt \%23DMB})/(\text{wt \% }C_6\text{ paraffins})$$

where i-$C_5$ is isopentane, 22DMB is 2,2-dimethylbutane, and 23DMB is 2,3-dimethylbutane.

Figure 4:
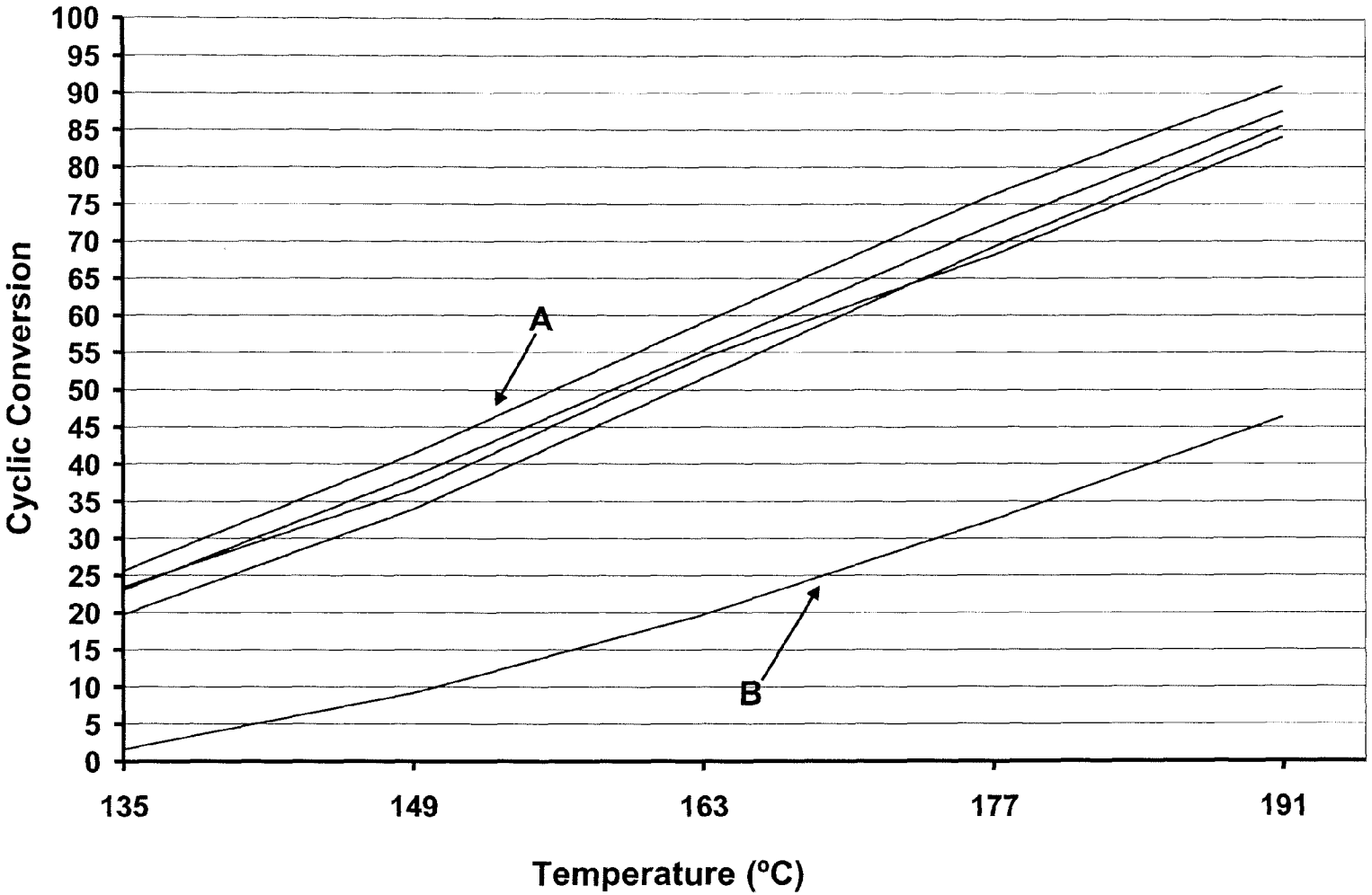
FIG. 4 is a plot of the percent of cyclic components converted to non-cyclic components versus temperature for an isomerization process using an available sulfated zirconia catalyst as compared to the isomerization catalyst of the present invention.

Another unexpected and non-obvious result of using this novel catalyst is that a substantially greater amount of cyclic components are converted to paraffins. These paraffins are subsequently isomerized to the high octane, high value, products. This unexpected benefit results in a more valuable product as compared to isomerization processes using other catalysts. FIG. 4 shows the cyclic component conversion ability of the catalyst used in the present invention as compared to an available sulfated zirconia isomerization catalyst. The catalyst of the current invention converts significantly more cyclic compounds than the available sulfated zirconia catalyst.

Yet another unexpected benefit of using this novel isomerization catalyst in the isomerization process is the sulfur and water tolerance of the catalyst. Other isomerization catalysts are generally known to be highly sensitive to sulfur and oxygen-containing compounds, thereby requiring that the feedstock be relatively free of such compounds. A sulfur concentration no greater than 0.5 ppm is generally required. With other catalysts, the presence of sulfur in the feedstock serves to temporarily deactivate the catalyst by platinum poisoning. Also, with other catalysts, water can act to permanently deactivate the catalyst. Therefore, in other systems, water, as well as oxygenates, in particular $C_1$-$C_5$ oxygenates, that can decompose to form water, can only be tolerated in very low concentrations. Feedstocks would have to be treated by any method that would remove water and sulfur compounds. For example, sulfur may be removed from the feed stream by hydrotreating and a variety of commercial dryers are available to remove water from the feed components. Adsorption processes for the removal of sulfur and water from hydrocarbon streams are also well known to those skilled in the art. However, due to the sulfur and water tolerance of the catalyst of the present invention, it is less likely that such feedstock treatments would be required. The elimination of feedstock treatment equipment results in a reduction in capital needed to construct the units and an ongoing reduction in the operating costs. Furthermore, costs associated with corrosion and emission control commonly encountered in some other isomerization processes are eliminated thereby making the present invention more economical.

Operating conditions within the isomerization zone are selected to maximize the production of isoalkane product from the feed components. Temperatures within the reaction zone will usually range from about 40°-235° C. Lower reaction temperatures are generally preferred since they usually favor equilibrium mixtures of isoalkanes versus normal alkanes. Lower temperatures are particularly useful in processing feeds composed of $C_5$ and $C_6$ alkanes where the lower temperatures favor equilibrium mixtures having the highest concentration of the most branched isoalkanes. When the feed mixture is primarily $C_5$ and $C_6$ alkanes temperatures in the range of from 60° to 160° C. are preferred. Thus, when the feed mixture contains significant portions of $C_4$-$C_6$ alkanes most suitable operating temperatures are in the range from 145° to 225° C. The reaction zone may be maintained over a wide range of pressures. Pressure conditions in the isomerization of $C_4$-$C_6$ paraffins range from 700 kPag to 7000 kPag. Preferred pressures for this process are in the range of from 1551 kPag to 3103 kPag. The feed rate to the reaction zone can also vary over a wide range. These conditions include liquid hourly space velocities ranging from 0.5 to 12 $hr^{-1}$ however, space velocities between 1 and 6 $hr^{-1}$ are preferred.

The isomerization zone is not restricted to a particular type of isomerization zone. The isomerization zone can consist of any type of isomerization zone that takes a stream of $C_5$-$C_6$ and possibly some $C_7$ straight-chain hydrocarbons or a mixture of straight-chain and branched-chain hydrocarbons and converts straight-chain hydrocarbons in the feed mixture to branched-chain hydrocarbons and branched hydrocarbons to more highly branched hydrocarbons thereby producing an effluent having branched-chain and straight-chain hydrocarbons. Often, the isomerization zone will consist of a single reactor. A multiple-reactor system with, for example, a first stage reactor and a second stage reactor in the reaction zone is an alternative embodiment. For a multiple reactor system, the catalyst used is distributed between the reactors in any reasonable distribution. The use of multiple reaction zones aids in maintaining lower catalyst temperatures. This is accomplished by having any exothermic reaction such as hydrogenation of unsaturates performed in the first vessel with the rest of the reaction carried out in a final reactor stage at more favorable temperature conditions. For example, the relatively cold hydrogen and hydrocarbon feed mixtures are passed through a cold feed exchanger that heats the incoming feed against the effluent from the final reactor. The feed from the cold feed exchanger is carried to the hot feed exchanger where the feed is heated against the effluent carried from the first reactor. The partially heated feed from hot feed exchanger is carried through an inlet exchanger that supplies any additional heat requirements for the feed and then into a first reactor. Effluent from the first reactor is carried to the second reactor after passage through an exchanger to provide inter-stage cooling. The isomerization zone effluent is conducted to an isomerization zone separator to separate isomerized products from isomerization zone light ends. The isomerized products are conducted to an isomerization zone stabilizer to further separate remaining light ends from an isomerate stream. The isomerate stream may be further processed or may blended with a gasoline pool to form motor fuel.

At least a portion of the isomerization zone light ends from the isomerization zone separator are combined with the reforming zone light ends from the reforming zone separator for additional processing. Combining the light ends streams from both the isomerization zone and the reforming zone conserves capital equipment costs and reduced utilities since only one net gas re-contacting zone is needed instead of two. For example, traditionally, the isomerization process would contain at least one compressor and drum for further separation of the light ends from the isomerate. Similarly, the reforming process would contain at least one compressor and drum for further separation of the light ends from the reformate. Combining the light ends from the isomerization zone and the reforming zone allow the elimination of at least one compressor and at least one separating device such as a re-contacting drum. Instead of the reforming process and the isomerization process each having one or more compressors and one or more re-contacting drums, at least a portion of the light ends from the isomerization zone may be routed to the net gas re-contacting zone of the reforming process.

The water and hydrogen sulfide tolerance of the specified isomerization zone catalyst allow for the gas system of the reforming zone and the isomerization zone to be combined, thereby eliminating the capital cost of one compressor. The net gas from the reforming zone typically contains contaminates that cannot be withstood by traditional isomerization catalysts. The water contaminate may come from a variety of sources such as the feed, the catalyst regeneration, and side reaction products. Hydrogen sulfide contaminate may result from side reactions of feed additives. The selection of an isomerization catalyst resistant to these common contaminates provided the opportunity to combine the combine the reforming zone and isomerization zone gas systems and realize a significant cost savings.

The combined light ends from the reforming zone and the isomerization zone are further processed in a net gas re-contacting zone to recover desired product from the $C_4$ and lighter boiling compounds. In one or more separators such as re-contacting drums, the combined lights ends stream is contacted with the reforming zone product stream from the reforming zone separator in order to form a product stream containing $C_5$ and heavier hydrocarbons and an overhead net gas stream which is made up of lighter hydrocarbons, i.e. $C_4$ and lighter boiling compounds, and hydrogen. Chloride treaters may be used to remove any chloride from the net gas stream. A portion of the overhead net gas stream may be recycled to the isomerization zone, the reforming, zone or both. A portion of the overhead net gas stream may be conducted to the naphtha hydrotreater or to other locations within a refinery.

The $C_5$ and heavier hydrocarbons from the product separation zone, after being used in the re-contacting drums, are conducted to a reforming zone stabilizer where additional $C_4$ and lighter hydrocarbons and some hydrogen are removed in a reforming zone stabilizer overhead stream and a reformate stream is also removed from the reforming zone stabilizer for gasoline blending to form motor fuel or further processing.

The isomerization zone stabilizer and the reforming zone stabilizer each have a stabilizer overhead stream containing $C_4$ and lighter hydrocarbons. The two overhead streams are combined and introduced to a common overhead receiver. Any liquid bottoms from the overhead receiver may be removed and the gas stream from the overhead receiver is combined with the isomerization zone light ends and the reforming zone light ends. The combined stream is processed through the net gas re-contacting zone.

One embodiment of the invention is shown in FIG. 1. An isomerization zone feed of the type previously described is introduced via line 32 to the isomerization zone 34 which contains the novel isomerization catalyst of the present invention. The isomerization zone is operated at conditions previously discussed. Hydrogen is admixed with the feed to the isomerization zone in an amount that will provide a hydrogen to hydrocarbon molar ratio of from 0.05 to 5.0 in the effluent from the isomerization zone. In this example, hydrogen is provided via recycle of the purified gas stream in line 68. The isomerization zone feed stream in line 32 may be heat exchanged with the isomerization zone effluent in line 36 before being introduced into isomerization zone 34. Within isomerization zone 34, isomerized products are generated using the novel catalyst of the present invention, and the isomerized products are conducted from the isomerization zone in line 36 as the isomerization zone effluent.

The isomerization zone effluent in line 36 is conducted to an isomerization zone product separator 38. The isomerization zone product separator 38 divides the isomerization effluent stream into an isomerized product stream 80 comprising $C_5$ and heavier hydrocarbons, and an isomerization zone separator overhead 82 which is made up of lighter hydrocarbons, $C_4$ and lighter boiling compounds, and hydrogen. Conditions for the operation of the product separator include pressures ranging from 172 to 4137 kPag. Specific embodiments utilize pressures ranging from 241 to about 1724 kpag. Suitable designs for rectification columns and separator vessels are well known to those skilled in the art. The isomerization zone separator overhead, a hydrogen-rich gas stream, is carried in line 82 from the product separator and may be divided into two portions, a first portion in line 84 and a second portion in line 86, or may be alternately routed through line 84 or line 86 depending upon the operation mode.

Hydrogen-rich gas streams 84 and 86 represent two different hydrogen management strategies. One option is a hydrogen-once-through mode where a portion of the reforming zone net gas is provided to the isomerization zone with the excess being removed in line 84 and conducted as net gas to the refinery. Line 84 may be combined with out net gas streams such as that in line 67. In this mode, stream 86 would be used only for catalyst regeneration which employs the reformer compressor as part of a gas recycle loop. In situations where the isomerization zone requires a higher hydrogen to hydrocarbon ratio, hydrogen in line 86 may be routed from the isomerization zone to combine with line 46 from the reforming zone separator 40 and conducted to first stage compressor 64 of a combined net gas re-contacting zone. A purified gas stream 68 may be recovered from the combined net gas re-contacting zone for recycle as hydrogen to the isomerization zone, further processing, or fuel gas use. Line 87 may be used to route the hydrogen to the second stage of a combined net gas re-contacting zone.

The isomerized product stream from isomerization separator 38 is conducted in line 80 to isomerization zone stabilizer 90 to remove light gases and butane. The amount of butane taken off from the stabilizer will vary depending upon the amount of butane entering the process. The isomerization zone stabilizer 90 normally runs at a pressure of from 800 to 1700 kPa absolute. The isomerate stream 92 from isomerization zone stabilizer 90 provides a stream comprising generally $C_5$ and higher boiling hydrocarbons that include aromatics, normal paraffins, and branched isomerized products.

Isomerate stream 92 may be heat exchanged with stream 80 and may be used for gasoline blending to form motor fuel, for fuel gas, or for further processing. $C_4$ and lighter hydrocarbons are taken overhead by line 94 combined with the reforming zone stabilizer overhead in line 72 and introduced to overhead receiver 96. The net gas stream from overhead receiver 96 is conducted in line 98 to combine with stream 54 prior to the introduction into first stage re-contracting drum 60. The liquid stream from the overhead receiver 96 is removed in line 100 and a portion is recycled as reflux to isomerization stabilizer 90 via line 104 and a portion is recycled to reforming stabilizer via line 106.

A reforming zone feedstock containing from $C_6$ to about $C_{11}$ or $C_{12}$ hydrocarbons with a boiling point range from about 82 to about 204° C. is introduced into a heat exchanger 12 via line 10. Heat exchanger 12 operates to exchange heat between the reforming zone effluent and the reforming zone feedstock. A heated reforming zone feed stream is withdrawn from heat exchanger 12 in line 14 and is passed through a heater 16 which is capable of interstage heating of multiple streams. The fully heated reforming zone feed stream 18 is passed to the first stage of a reforming reactor 20 containing reforming catalyst. FIG. 1 shows the reforming reactor to be of a continuous catalyst regeneration type where spent catalyst is continuously removed from the reactor in line 24 and conducted to a regeneration zone 22. Regenerated catalyst is introduced into reforming reactor 20 via line 26. At each stage of the reforming reactor, the reaction mixture is conducted from reforming reactor 20 to interstage heater 16 and then the heated reaction mixture is returned to reforming reactor 20. Reforming zone effluent 28 is conducted to heat exchanger 12 where the heat from the reforming zone effluent is exchanged with the reforming zone feed stream to at least partially heat the reforming zone feed stream. The reforming zone effluent containing reformate is withdrawn from heat exchanger 12 in line 30.

The reforming zone effluent in line 30 is conducted to reforming zone product separator 40 which separates the reforming zone effluent into a reforming zone product stream 42 comprising $C_5$ and heavier hydrocarbons, and a reforming zone overhead gas stream 44 which is made up of lighter hydrocarbons, $C_4$ and lighter boiling compounds, and hydrogen. Conditions for the operation of the reforming zone product separator include pressures ranging from 172 to 4137 kPag. Specific embodiments utilize pressures from 241 to about 1723 kPag. Suitable designs for rectification columns and separator vessels are well known to those skilled in the art. A hydrogen-rich gas stream is carried in line 44 from reforming zone product separator 40 and divided into two portions, a first portion in line 46 and a second portion in line 48. Line 48 is recycled using recycle compressor 52 to combine with the reforming zone feedstock in line 10. The portion of the hydrogen-rich gas stream from the reforming zone product separator in line 46 is conducted to a net gas re-contacting zone where further separation is conducted. The portion of the hydrogen-rich gas stream from the reforming zone product separator in line 46 is combined with the second portion of the isomerization zone separator overhead in line 86 to form stream 54 which is introduced to the first stage compressor 64. After passing thought first stage compressor 64, stream 54 is combined with net gas stream 98 from overhead receiver 96 to form stream 88.

The product stream from reforming zone product separator 40 is conducted in line 42 and is combined with the overhead gas stream 62 from first stage re-contacting drum 60 after passing through second stage compressor 66 to form a combined second stage stream 72. The combined second stage stream 72 is introduced to second stage re-contacting drum 56. In the re-contacting drum, the liquid from stream 42 acts to extract additional desirable product from the gas stream 62. The liquid product from second stage re-contacting drum 56 is conducted in line 74 to combine with combined stream 88 (comprising the combination of both streams 54 and 98) and then introduced into first stage re-contacting drum 60. The overhead gas stream from second stage re-contacting device 56 is conducted in line 76 to chloride treater 78 to remove any chloride that may be present. At least a portion of purified gas stream 68 from chloride treater 78 is combined with isomerization feed in line 32 and introduced to the isomerization zone 34. Other portions of purified gas stream 68 may be conducted elsewhere in the refinery via line 67 or to naphtha hydrotreater via line 69.

The liquid product stream from first stage re-contacting drum 60 is conducted in line 70 to reforming zone stabilizer 58 that removes light gases and butane. The amount of butane taken off from the stabilizer will vary depending upon the amount of butane entering or formed in the process. The stabilizer normally runs at a pressure of from 800 to 1700 kPaa. The bottoms stream 62 from reforming zone stabilizer 58 provides a stream comprising generally $C_5$ and higher boiling hydrocarbons that include aromatics, normal paraffins, and some branched isomerized products. The stream is primarily reformate and some isomerate. Bottoms stream 62 may be heat exchanged with stream 70 and may be used for gasoline blending to form motor fuel, for fuel gas, or for further processing. $C_4$ and lighter hydrocarbons from reforming zone stabilizer 58 are taken overhead by line 72 and passed to overhead receiver 96. Reforming zone stabilizer overhead in line 72 may be combined with isomerization zone stabilizer overhead 94 prior to introduction into overhead receiver 96.

As discussed briefly above, the flow scheme also provides a process for regenerating the isomerization catalyst using the net gas compressor of the reforming zone. Looking at FIG. 1, regeneration gas is introduced into isomerization reactor 34 and the effluent from the isomerization zone reactor 34 is separated in product separator 38 into a waste stream and a regeneration gas recycle stream. Line 86 from isomerization zone product separator 38 is used to conduct the regeneration gas recycle stream from isomerization zone product separator 38 to reforming zone first stage compressor 64, and then to line 68. Valve 110 is set so that the portion of line 68 from chloride treaters 78 to valve 110 is closed. The regeneration gas recycle stream from line 86 is therefore routed through the remainder of line 68 to isomerization zone reactor 34. Line 112 conducts air from the reforming zone regeneration operation to isomerization zone reactor 34 to regenerate the isomerization catalyst. Line 114 provides a conduit to route the air to the reforming regeneration zone when necessary during the process. Of course, during regeneration of the isomerization catalyst the hydrocarbon feed to the isomerization zone, and any heat exchange thereof, is discontinued. The primary benefit of the regeneration flow scheme of FIG. 1 is the additional use of first stage compressor 64 thereby eliminating the need for additional compressors.

The present invention provides a process with reduced costs through the sharing of compressors, first and second stage re-contacting drums, and overhead receiver. However, the process retains the flexibility resulting from separately recovering an isomerate product and a reformate product. Each of these products may be used independently thereby maximizing the flexibility of the process.

It is also envisioned that a single stage net gas re-contacting zone may be employed instead of the two-stage zone shown in FIG. 1. For example, one compressor and one re-contacting drum would be employed instead of two. Furthermore, the reforming zone may be operated in a semi-continuous regeneration mode as opposed to the continuous catalyst regeneration mode (CCR) shown in FIG. 1.

EXAMPLE

A comparison between the isomerization zone with the isomerization catalyst of the present invention and an isomerization process using an available sulfated zirconia catalyst was conducted using pilot plants. The pilot plants were equipped with a reactor and a gas chromatograph. The catalysts used included a catalyst containing 2.7 wt. % ytterbium, about 0.3 wt. % platinum, and 4.6 wt. % sulfate and a reference sulfated zirconia catalyst as described in U.S. Pat. No. 5,036,085 and U.S. Pat. No. 5,120,898 for comparison. Approximately 10.5 g of each sample was loaded into a multi-unit reactor assay. The catalysts were pretreated in air at 450° C. for 2-6 hours and reduced at 200° C. in hydrogen for 14 hours. Hydrogen and a feed stream containing 34 wt. % n-pentane, 55 wt. % n-hexane, 9.2 wt. % cyclohexane and methylcyclopentane and 1.8 wt. % n-heptane was passed over the catalysts at 135° C., 149° C., 163° C., 177° C. and 191° C., at approximately 250 psig, and 2.0 $hr^{-1}$ WHSV. The hydrogen to hydrocarbon molar ratio was 1.3. The products were analyzed using online gas chromatographs and the percent conversion to high-value products and of cyclohexane was determined at the different temperatures.

The results are shown in FIGS. 2, 3, and 4 showing (1) an increase in the research octane value of the product stream, (2) an increase in the amount of iso-paraffins in the product stream, and (3) that a significant amount of cyclic compounds were converted to noncyclic compounds, likely through ring opening followed by isomerization, thereby demonstrating the unexpected results of the platinum and ytterbium on sulfated zirconia catalyst used in the present invention as compared to an available sulfated zirconia catalyst.

Turning to FIG. 2 the curves labeled A represent data collected in experiments using the novel isomerization catalyst of the present invention while the curve labeled B represents data collected in the experiment using the available sulfated zirconia catalyst. The research octane number of the product streams were plotted versus time. It is clear from the plot that the research octane number of the present invention is significantly higher than that achieved using the available sulfated zirconia catalyst.

Turning to FIG. 3, again the curves labeled A represent data collected in experiments using the novel isomerization catalyst of the present invention while the curve labeled B represents data collected in the experiment using the available sulfated zirconia catalyst. The PIN (as defined above) is plotted versus temperature. It is clear that the present invention provides a significantly high PIN, indicating a greater amount of isoparaffin products, as compared to that achieved using the available sulfated zirconia catalyst.

FIG. 4 shows one unexpected result of the present invention. As with FIGS. 2 and 3, in FIG. 4 the curves labeled A represent data collected in experiments using the novel catalyst of the present invention while the curve labeled B represents data collected in the experiment using the available sulfated zirconia catalyst. The amount of cyclic components that are converted to non-cyclic components, most likely though ring opening, are plotted versus the temperature. It is clear that the isomerization catalyst of the present invention provides for a greater degree of cyclic components being converted to non-cyclic components than that achieved when using the available sulfated zirconia catalyst.

The invention claimed is:

1. A process comprising:

isomerizing an paraffinic feedstock in the presence of an isomerization catalyst in a isomerization reaction zone, charging a regeneration gas stream to the isomerization zone containing an at least partially spent isomerization catalyst to regenerate the isomerization catalyst;

separating the isomerization zone effluent into a waste stream and a regeneration gas recycle stream;

conducting the regeneration gas recycle stream to the isomerization zone using a reforming zone compressor;

wherein the isomerization catalyst is a solid acid catalyst comprising a support comprising a sulfated oxide or hydroxide of at least an element of Group IVB (IUPAC 4) of the Periodic Table, a first component selected from the group consisting of at least one lanthanide series element, mixtures thereof, and yttrium, and a second component selected from the group consisting of platinum group metals and mixtures thereof and wherein the atomic ratio of the first component to the second component is at least about 2.

* * * * *